US009671753B2

(12) United States Patent
Yamashita

(10) Patent No.: US 9,671,753 B2
(45) Date of Patent: Jun. 6, 2017

(54) IMAGE FORMING APPARATUS CAPABLE OF COOLING INTERNAL DEVICES, COOLING DEVICE FOR COOLING INTERNAL DEVICES OF IMAGE FORMING APPARATUS

(71) Applicant: KYOCERA Document Solutions Inc., Osaka-shi, Osaka (JP)

(72) Inventor: Kazuya Yamashita, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/084,385

(22) Filed: Mar. 29, 2016

(65) Prior Publication Data

US 2016/0291541 A1 Oct. 6, 2016

(30) Foreign Application Priority Data

Mar. 30, 2015 (JP) ..... 2015-068928

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92
See application file for complete search history.

(56) References Cited

U.S. PATENT DOCUMENTS

2006/0114654 A1 6/2006 Kiyosumi
2007/0212104 A1* 9/2007 Miyamoto ..... G03G 21/206 399/92
2015/0003859 A1* 1/2015 Tanida ..... G03G 21/206 399/92

FOREIGN PATENT DOCUMENTS

JP 2006154462 A 6/2006
JP 2011180161 A 9/2011

OTHER PUBLICATIONS

European Patent Office, Extended European Search Report Issued in Application No. 16162590.0, Aug. 18, 2016, Germany, 7 pages.

* cited by examiner

*Primary Examiner* — Hoang Ngo
(74) *Attorney, Agent, or Firm* — Alleman Hall Creaseman & Tuttle LLP

(57) ABSTRACT

In an image forming apparatus, a duct portion provided on a side surface of a partition wall member on a first space side includes first and second internal passages. The first internal passage allows air that has flowed in from a first air passage to flow and guides the air to a second air passage. The second internal passage allows air that has flowed in from a second air passage to flow and guides the air to a second space via a communication port formed in a partition wall member. A first blower provided in the first space sucks air from the first air passage and blows out the air to the first internal passage. A second blower provided in the second space sucks air from the second air passage and blows out the air to the second space through the second internal passage and the communication port.

1 Claim, 6 Drawing Sheets

IMAGE FORMING APPARATUS CAPABLE OF COOLING INTERNAL DEVICES, COOLING DEVICE FOR COOLING INTERNAL DEVICES OF IMAGE FORMING APPARATUS

INCORPORATION BY REFERENCE

This application is based upon and claims the benefit of priority from the corresponding Japanese Patent Application No. 2015-068928 filed on Mar. 30, 2015, the entire contents of which are incorporated herein by reference.

BACKGROUND

The present disclosure relates to an image forming apparatus for cooling the devices in a housing by using a fan that generates air flows, and relates to a cooling device.

There is known an image forming apparatus, such as a copier or a printer, that forms an image on a sheet member based on the electrophotography. The image forming apparatus includes a developing device for developing an electrostatic latent image formed on a photoconductor drum. The developing device includes a toner storage portion that stores toner. The developing device forms a toner image on the photoconductor drum by using the toner stored in the toner storage portion.

Meanwhile, in a configuration where a heating device is used to fix the toner image to the sheet member, a peripheral temperature of the toner storage portion may increase due to an influence of peripheral air heated by the heating device. In addition, the image forming apparatus includes devices, such as a motor and a power supply board, that become heat sources upon receiving a power supply, and a peripheral temperature of the toner storage portion may increase due to an influence of the heat emitted from the heat sources, other than the heating device. The toner is made of resin. As a result, when toner temperature increases as the peripheral temeratuere increases, fluidity of toner decreases. In addition, for the toner to be adhered to the photoconductor drum, it is necessary to impart charge to the toner. However, as the temperature rises, the charged amount of toner is decreased. If the fluidity of toner or the charged amount of toner decreases, a sufficient amount of toner does not adhere to the photoconductor drum, and an image defect, such as an image density reduction, occurs. As a result, a variety of methods for inhibiting the temperature rise caused by heat sources have been proposed. For example, a cooling device for cooling the power supply board and a power supply device in a housing has been proposed.

SUMMARY

An image forming apparatus according to an aspect of the present disclosure includes a housing, a partition wall member, a developing portion, a transfer portion, a first air passage, a second air passage, a duct portion, a first blower, and a second blower. The housing has a first surface and a second surface that are disposed opposite to each other. An air inlet is formed in the first surface. The partition wall member divides an inner space of the housing into a first space and a second space. The first space is on a first surface side, and the second space is on a second surface side. The developing portion is disposed in the first space and performs a developing process by using toner. The transfer portion is disposed above the developing portion and includes a transfer belt that extends in a horizontal direction.

The first air passage is formed below the developing portion and extends from the air inlet toward the second surface. The second air passage is formed above the transfer portion and extends from the air inlet toward the second surface. The duct portion is provided on a side surface of the partition wall member on a first space side and includes a first internal passage and a second internal passage. The first internal passage allows air that has flowed in from the first air passage to flow therein and guides the air to the second air passage. The second internal passage allows air that has flowed in from the second air passage to flow therein and guides the air to the second space via a communication port that is formed in the partition wall member. The first blower is provided in the first space and is configured to suck air from the first air passage and blow out the air to the first internal passage of the duct portion. The second blower is provided in the second space and is configured to suck air from the second air passage and blow out the air to the second space through the second internal passage of the duct portion and the communication port.

A cooling device according to another aspect of the present disclosure cools internal devices of an image forming apparatus by taking in air from an air inlet formed in a side surface of a housing of the image forming apparatus and allowing the air to flow though a first air passage and a second air passage in separation. The cooling device includes a duct portion, a first blower, and a second blower. The duct portion is provided in a first space which is one of two spaces into which an inner space of the housing is divided by a partition wall member provided in the housing. The duct portion includes a first internal passage and a second internal passage. The first internal passage allows air that has flowed in from the first air passage to flow therein and guides the air to the second air passage. The second internal passage allows air that has flowed in from the second air passage to flow therein and guides the air to a second space via a communication port that is formed in the partition wall member. The second space is the other one of the two spaces. The first blower is provided in the first space and is configured to suck air from the first air passage and blow out the air to the first internal passage of the duct portion. The second blower is provided in the second space and is configured to suck air from the second air passage and blow out the air to the second space through the second internal passage of the duct portion and the communication port.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5B is a diagram showing the cooling device taken along a plane VB-VB of FIG. 5A.

DETAILED DESCRIPTION

Figure 1:
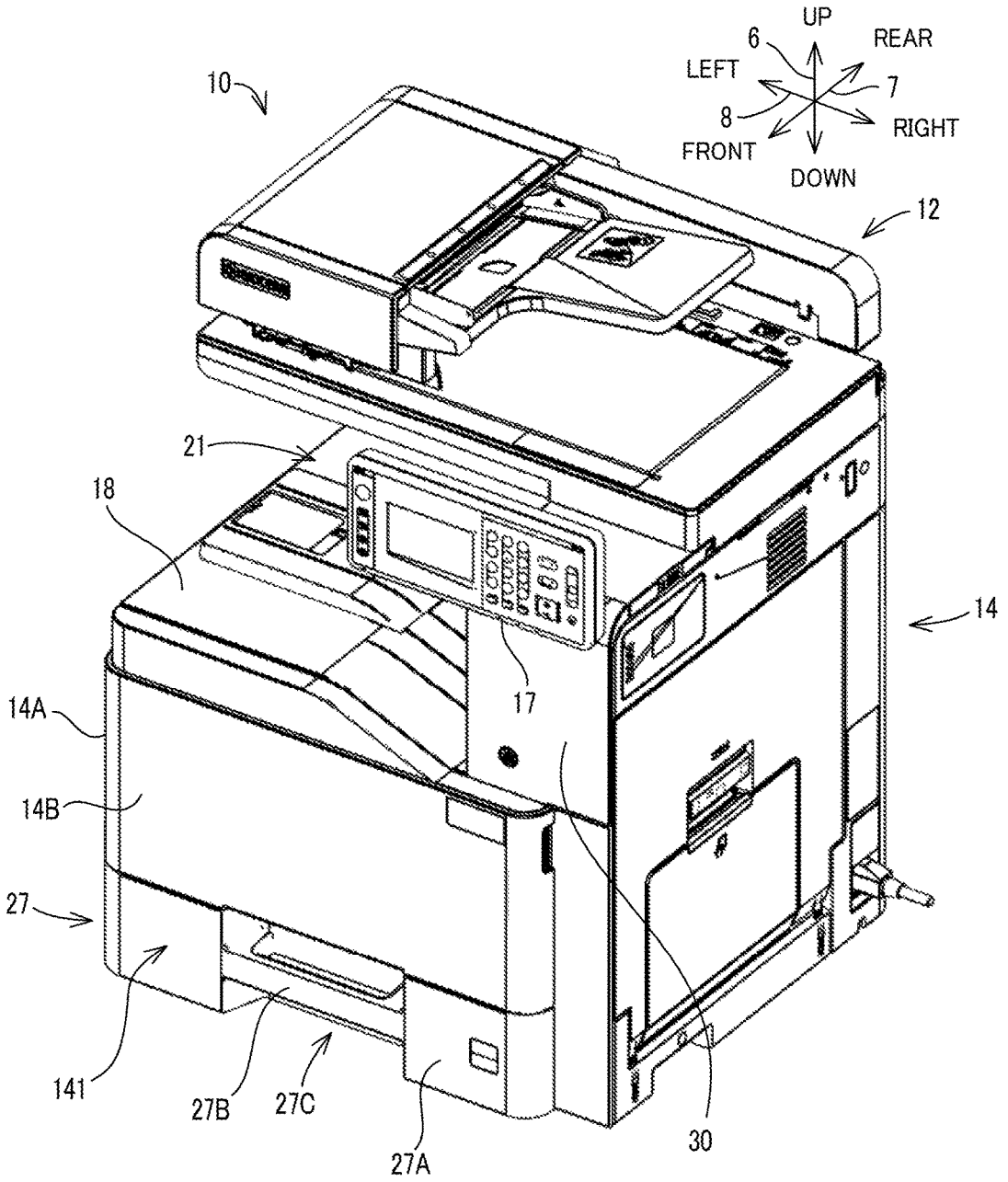
FIG. 1 is a perspective view showing an image forming apparatus according to an embodiment of the present disclosure.

In the embodiment of the present disclosure, for the sake of explanation, an up-down direction 6 is defined as a vertical direction in the state where an image forming apparatus 10 is installed usable (the state shown in FIG. 1). In addition, a front-rear direction 7 is defined on the supposition that the side on which an operation/display portion 17 is provided in the above-mentioned installment state is the front side. Furthermore, a left-right direction 8 is defined based on the image forming apparatus 10 in the above-mentioned installment state viewed from the front side.

The image forming apparatus 10 includes an image reading portion 12 and an image forming portion 14. The image reading portion 12 performs a process of reading an image from a document sheet, and is provided in the upper part of the image forming apparatus 10. The image forming portion 14 performs a process of forming a color image based on the electrophotography, and is provided in the lower part of the image forming apparatus 10. In addition, a sheet discharge portion 30 is provided on the right side of the image forming portion 14.

Above the image forming portion 14, there is provided a discharge space 21. The sheet discharge portion 30 is formed in such a way as to couple the image forming portion 14 and the image reading portion 12 vertically with the discharge space 21 formed therebetween. As shown in FIG. 1, the front side and the left side of the discharge space 21 are opened. In addition, the rear side of the discharge space 21 is not opened, but is closed by a rear-surface cover (not shown). Furthermore, the sheet discharge portion 30 is provided on the right side of the discharge space 21. In this way, the right side of the sheet discharge space 21 is closed by the sheet discharge portion 30.

Figure 6:
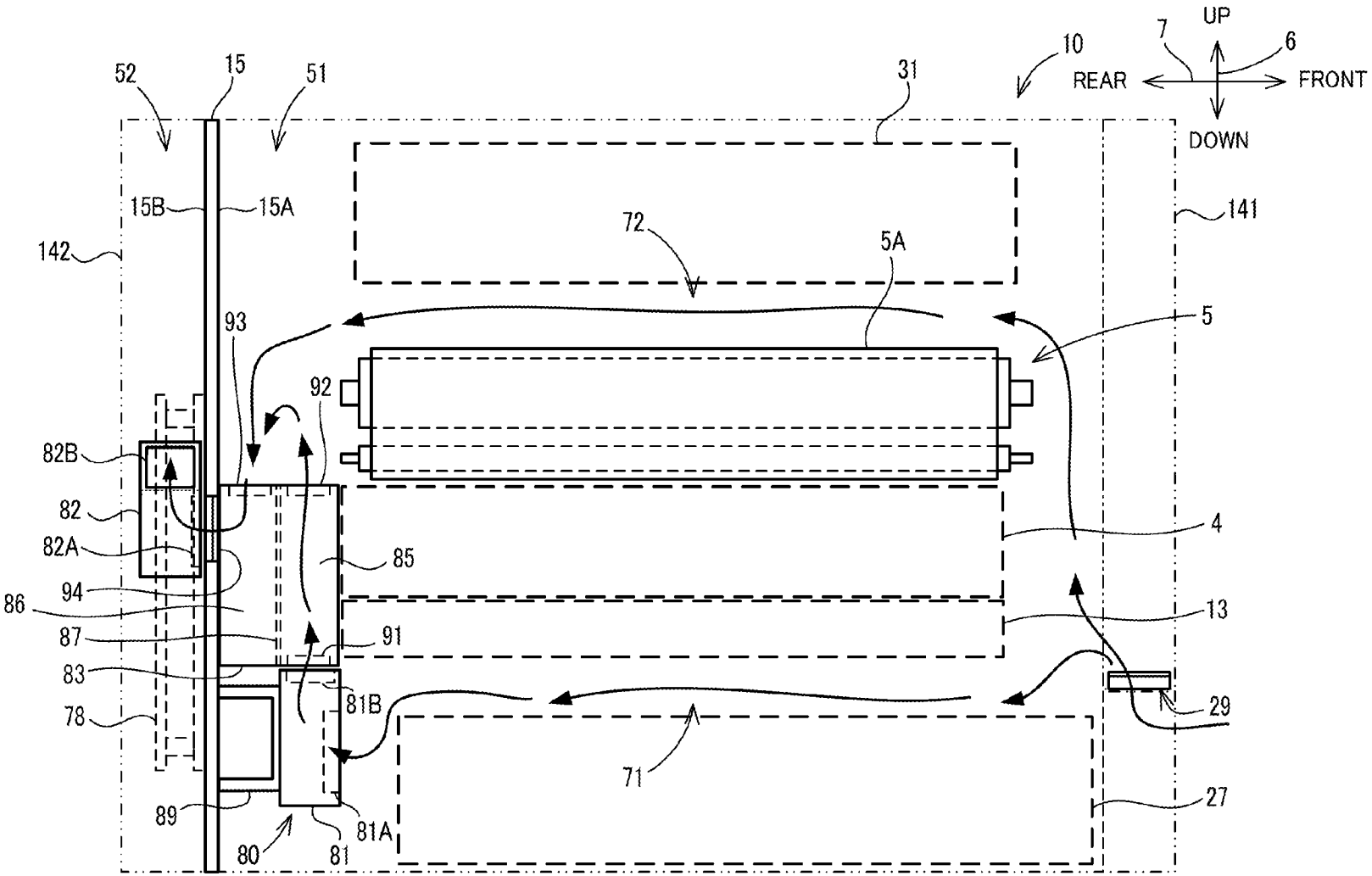
FIG. 6 is a diagram showing the flows of air in the image forming apparatus according to an embodiment of the present disclosure.

The image forming portion 14 includes a housing 14A as an apparatus main body. A plurality of internal devices that constitute the image forming portion 14 are disposed inside the housing 14A. The housing 14A includes an outer frame and an inner frame, wherein the outer frame covers the whole of the image forming portion 14, and the inner frame supports the components constituting the image forming portion 14. The housing 14A, as a whole, has an approximately rectangular parallelepiped shape. A front surface 141 (see FIG. 1) of the housing 14A corresponds to the first surface of the present disclosure, and a rear surface 142 (see FIG. 4) that is disposed opposite to the front surface 141 corresponds to the second surface of the present disclosure. In addition, the housing 14A includes a partition plate 15 inside thereof (see FIG. 6, an example of the partition wall member of the present disclosure). As shown in FIG. 6, inside the housing 14A, the partition plate 15 is located close to the rear side. The partition plate 15 is a flat plate disposed parallel to the rear surface 142. The partition plate 15 divides the inner space of the housing 14A into a first space 51 and a second space 52, wherein the first space 51 is on the front surface 141 side and the second space 52 is on the rear surface 142 side.

Figure 2:
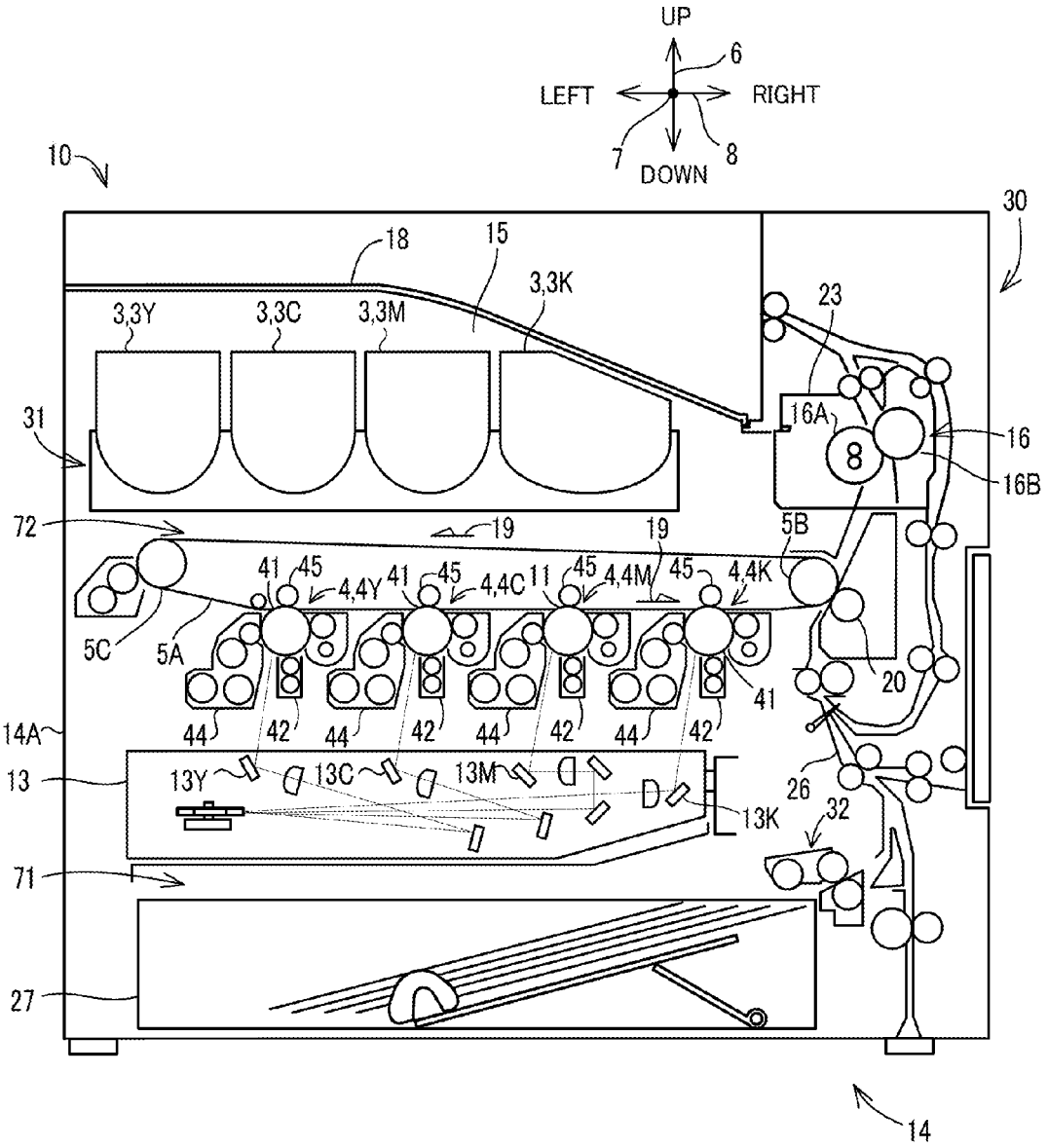
FIG. 2 is a diagram showing the inner configuration of an image forming portion.

The image forming portion 14 forms a color image on a sheet member based on a so-called tandem system. As shown in FIG. 2, the image forming portion 14 includes a plurality of image forming units 4, an intermediate transfer unit 5 (an example of the transfer portion of the present disclosure), a laser scanning device 13, a secondary transfer roller 20, a fixing device 16, a sheet discharge tray 18, a sheet feed cassette 27 (an example of the sheet storage portion of the present disclosure), a sheet feed unit 32, an operation/display portion 17 (see FIG. 1), a conveyance path 26, a container unit 31 (an example of the container attachment portion of the present disclosure), a power supply control board 78 (an example of the control board of the present disclosure), a cooling device 80, and a control portion (not shown). It is noted that in FIG. 2, the image reading portion 12 is omitted. In the present embodiment, the image forming units 4, the intermediate transfer unit 5, the laser scanning device 13, the secondary transfer roller 20, the fixing device 16, the sheet feed cassette 27, and the sheet feed unit 32 are provided in the first space 51. In addition, the power supply control board 78 is provided in the second space 52. Furthermore, as described below, a part (a second fan 82) of the cooling device 80 is provided in the second space 52, and the remaining part (a first fan 81 and a duct portion 83) of the cooling device 80 is provided in the first space 51.

The operation/display portion 17 is a touch panel or the like that displays a variety of types of information in accordance with control signal from the control portion, and inputs a variety of types of information to the control portion in response to user operations.

The image forming units 4 (4Y, 4C, 4M, and 4K) are disposed below the intermediate transfer unit 5. Each of the image forming units 4 includes a photoconductor drum 41, a charging device 42, a developing device 44 (an example of the developing portion of the present disclosure), and a primary transfer roller 45. The image forming units 4 form images based on the electrophotography. The image forming units 4 are arranged in alignment along the running direction (the direction indicated by the arrow 19) of a transfer belt 5A. The image forming unit 4Y forms a toner image on the surface of the photoconductor drum 41 by using yellow toner. The image forming units 4C, 4M and 4K form toner images on the surfaces of the corresponding photoconductor drums 41 by using cyan toner, magenta toner, and black toner, respectively. Each of the developing devices 44 performs a developing process of developing a toner image on the corresponding photoconductor drum 41.

In the present embodiment, four image forming units 4 are provided. As a result, four photoconductor drums 41 and four developing devices 44 are provided in the housing 14A. The photoconductor drums 41 and the developing devices 44 are arranged in alignment along the extension direction of the transfer belt 5A, namely, along the running direction of the transfer belt 5A. The photoconductor drums 41 are rotatably supported by, for example, an inner frame of the housing 14A. The housing 14A includes a transmission mechanism (not shown) such as a gear train for transmitting the power to the rotation shafts of the photoconductor drums 41, and when a driving force is transmitted to the transmission mechanism from a motor, the photoconductor drums 41 are rotated in a predetermined direction. The developing devices 44 perform the developing process on the rotating photoconductor drums 41 by using toner. The photoconductor drums 41 carry, on their surfaces, toner images that are formed as the developing devices 44 perform the developing process.

The sheet feed cassette 27 is provided below the image forming portion 14. In the housing 14A, the sheet feed cassette 27 is provided below the developing devices 44, namely, below the image forming units 4. The sheet feed cassette 27 is formed in the shape of a rectangular box whose top surface is opened, and can store a plurality of sheet members therein. The sheet feed unit 32 picks up, one by one, sheet members stacked in the sheet feed cassette 27, and feeds the sheet member toward the conveyance path 26.

Figure 3:
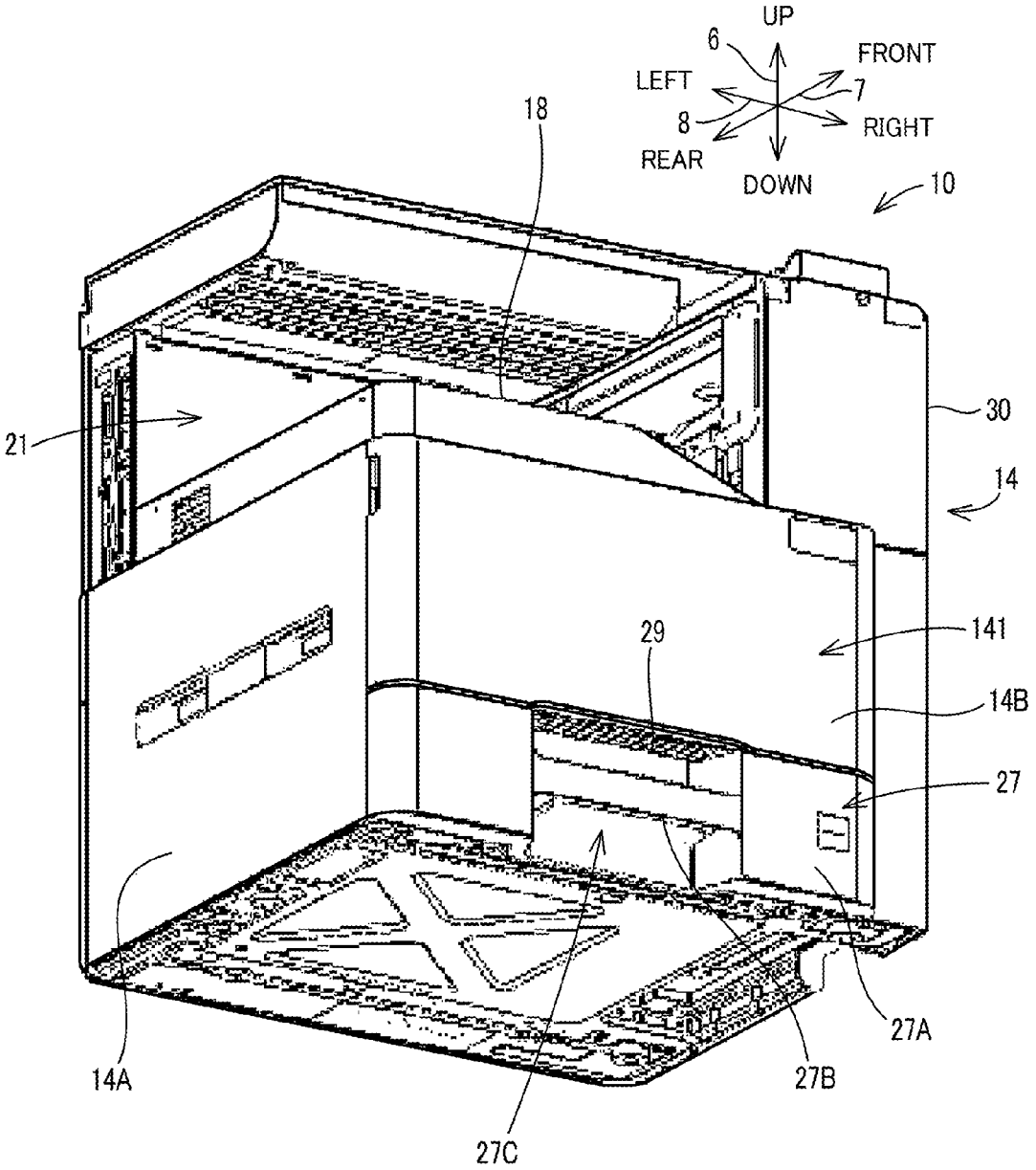
FIG. 3 is a perspective view of the image forming apparatus viewed from the bottom side.

The sheet feed cassette 27 is configured to be inserted into the housing 14A from the front surface 141 side in the front-rear direction 7, and extracted to the front surface 141 side. Specifically, the sheet feed cassette 27 is supported so as to be slidable in the front-rear direction 7 in the lower portion of the housing 14A. A well-known rail support mechanism or the like is adopted as the support mechanism for supporting the sheet feed cassette 27. As shown in FIG. 3, the sheet feed cassette 27 has a front panel 27A on the front side thereof. It is noted that the cover member of the image reading portion 12 is omitted in FIG. 3. In the state where the sheet feed cassette 27 is attached to the housing 14A (the state shown in FIG. 1 to FIG. 3), the front panel 27A forms the front surface 141 of the housing 14A, together with a front cover 14B that is described below. That is, the front panel 27A is a part of the front surface 141 of the housing 14A. The front panel 27A has a handle 27B which can be gripped when the sheet feed cassette 27 is inserted or extracted. A recessed portion 27C, recessing toward the rear side, is formed at the center of the front panel 27A, and the handle 27B is made to run across the center of the recessed portion 27C in the left-right direction 8. An air inlet 29 communicating with the inner space of the housing 14A is formd in a top wall surface of the recessed portion 27C. That is, the air inlet 29 is formed in the front surface 141 of the housing 14A. As a result, air outside the image forming apparatus 10 can flow into the housing 14A via the air inlet 29.

As shown in FIG. 2, the intermediate transfer unit 5 is provided above the image forming units 4. The intermediate transfer unit 5 includes a transfer belt 5A, a driving roller 5B and a driven roller 5C. The transfer belt 5A is disposed above the photoconductor drums 41. The transfer belt 5A is an endless annular belt made of a resin member having conductivity. The transfer belt 5A extends in a predetermined direction, more specifically in a horizontal direction. In other words, the transfer belt 5A is approximately horizontal and extends in the left-right direction 8 in the state where the image forming apparatus 10 is installed. Opposite ends of the transfer belt 5A in the left-right direction 8 are supported by the driving roller 5B and the driven roller 5C that are separated from each other in the left-right direction 8 so that the transfer belt 5A can move around them. Thus the transfer belt 5A extends in the left-right direction 8 which is perpendicular to the front-rear direction 7 extending from the front surface 141 toward the rear surface 142. In the present embodiment, the transfer belt 5A is suspended between and supported by the driving roller 5B and the driven roller 5C.

The transfer belt 5A is a belt member on which toner images of respective colors are transferred from the photoconductor drums 41 of the image forming units 4. Supported by the driving roller 5B and the driven roller 5C, the transfer belt 5A can move (run) in a direction indicated by the arrow 19 in the state where its surface is in contact with the surfaces of the photoconductor drums 41. When the transfer belt 5A passes through between the primary transfer roller 45 and the photoconductor drums 41, the toner images are transferred in sequence from the photoconductor drums 41 to the surface of the transfer belt 5A in such a way as to be overlaid with each other.

The image forming units 4 form a color image based on the tandem system. The plurality of image forming units 4 are arranged in alignment along the running direction (horizontal direction) of the transfer belt 5A. The image forming units 4Y, 4C, 4M and 4K for yellow, cyan, magenta and black are arranged in alignment in the stated order from left to right of the transfer belt 5A.

The laser scanning device 13 is provided below the image forming units 4, more specifically, between the image forming units 4 and the sheet feed cassette 27. The laser scanning device 13 includes a laser light source that emits a laser beam for the above-mentioned colors, a polygon mirror for scanning the laser beam, a motor for rotationally driving the polygon mirror, and mirrors 13Y, 13C, 13M and 13K for reflecting the scanned laser beam. The laser scanning device 13 forms electrostatic latent images respectively on the photoconductor drums 41 by irradiating the laser beam to the photoconductor drums 41 of the image forming units 4 based on the input image data of the respective colors.

As shown in FIG. 2, a gap is formed between the laser scanning device 13 and the sheet feed cassette 27. In other words, the sheet feed cassette 27 is formed at a position that is a predetermined distance away downward from the bottom surface of the laser scanning device 13. The gap between the bottom surface of the laser scanning device 13 and the top surface of the sheet feed cassette 27 is a first air passage 71 through which passes the air that has flowed in from outside through the air inlet 29 (see FIG. 3) of the front surface 141. That is, the first air passage 71 is formed between the plurality of developing devices 44 and the sheet feed cassette 27. The first air passage 71 plays a role of an air duct that is defined by the bottom surfaces of the developing devices 44 and the top surface of the sheet feed cassette 27. In the present embodiment, as shown in FIG. 2, the first air passage 71 is formed below the developing devices 44 and extends from the front surface 141 of the housing 14A rearward, toward the rear surface 142. The first air passage 71 extends from the air inlet 29 of the front surface 141 and reaches the partition plate 15 disposed on the rear surface 142 side. It is noted that in a configuration where the laser scanning device 13 is not located below the developing devices 44 and the sheet feed cassette 27 is disposed directly below the developing devices 44, the first air passage 71 is a gap between the developing devices 44 and the sheet feed cassette 27.

The secondary transfer roller 20 is disposed to face the driving roller 5B across the conveyance path 26 that extends vertically. When a transfer potential is applied to the secondary transfer roller 20, the toner image on the transfer belt 5A is transferred to a sheet member. The sheet member with the image transferred thereto is conveyed to the fixing device 16.

The fixing device 16 is disposed more on the right side than the intermediate transfer unit 5. Specifically, the fixing device 16 is disposed more on the right side than the driving roller 5B and more on the upper side than the secondary transfer roller 20. The fixing device 16 applies heat to the toner image transferred to the sheet member so that the toner image is fixed to the sheet member. The fixing device 16 is disposed at approximately the same height position as toner containers 3 that are described below, in the horizontal direction. As shown in FIG. 2, the fixing device 16 is disposed in the vicinity of the right end of the housing 14A. The fixing device 16 includes a housing 23, a heating roller 16A, and a pressure roller 16B. The heating roller 16A and the pressure roller 16B are disposed in the housing 23.

A heating device 16C is provided inside the heating roller 16A, and the heating roller 16A is heated by the heating device 16C to a predetermined temperature at which the toner can be fixed. The pressure roller 16B is disposed to face the heating roller 16A. The heating roller 16A is disposed on the left side and the pressure roller 16B is disposed on the right side in such a manner that the conveyance path 26 extending in the vertical direction is nipped by the heating roller 16A and the pressure roller 16B. The pressure roller 16B is biased by an elastic member (not shown) to be pressed against the heating roller 16A. In the fixing device 16, the sheet member is conveyed while being nipped by the heating roller 16A and the pressure roller 16B. During this conveyance, heat is transmitted to the toner image that has been transferred onto the sheet member. This allows the toner image to be fused and fixed to the sheet member. After this, the sheet member is discharged onto the sheet discharge tray 18.

The sheet discharge tray 18 is provided in the sheet discharge space 21. As shown in FIG. 2, the sheet discharge tray 18 is disposed above the intermediate transfer unit 5. Specifically, the sheet discharge tray 18 is disposed above the toner containers 3 that are described below so as to cover the top surfaces of the toner containers 3. The sheet discharge tray 18 holds sheet members that have been discharged to outside from the sheet discharge portion 30 after passing through the fixing device 16.

The container unit 31 is disposed above the intermediate transfer unit 5. To the container unit 31, a plurality of toner containers 3 are attached in a detachable manner. The container unit 31 is provided on the inner frame of the housing 14A. The container unit 31 is disposed at a position that is a predetermined distance away upward from the top surface of the upper portion of the transfer belt 5A. This allows a gap to be formed between the transfer belt 5A and the container unit 31. The gap between the transfer belt 5A and the container unit 31 is a second air passage 72 through which passes air that has flowed in from outside through the air inlet 29 (see FIG. 3) of the front surface 141. That is, the second air passage 72 is formed between the transfer belt 5A and the container unit 31. The second air passage 72 plays a role of an air duct that is defined by the bottom surface of the container unit 31 and the top surface of the transfer belt 5A. In the present embodiment, as shown in FIG. 2, the second air passage 72 is formed above the intermediate transfer unit 5, and extends from the front surface 141 of the housing 14A rearward toward the rear surface 142. The second air passage 72 extends from the air inlet 29 of the front surface 141 and reaches the partition plate 15 disposed on the rear surface 142 side.

The toner containers 3 store toner inside and are supported by the container unit 31 in the attachable/detachable manner. Specifically, the toner containers 3 are respectively attached to the storage chambers (not shown) provided in the container unit 31 from the front side of the housing 14A. When the front cover 14B (see FIG. 1) of the housing 14A is opened, the front side of the container unit 31 is exposed. In that state, the toner containers 3 are inserted into the storage chambers of the container unit 31 from the front side toward the rear side so as to be attached to the storage chambers of the container unit 31. In the state where the toner containers 3 are attached to the container unit 31, toner can be supplied from the toner containers 3 to the developing device 44 through toner conveyance paths (not shown).

The plurality of toner containers 3 are arranged in alignment along the running direction (horizontal direction) of the transfer belt 5A. In order from left to right of the transfer belt 5A, a toner container 3Y for yellow toner, a toner container 3C for cyan toner, a toner container 3M for magenta toner, and a toner container 3K for black toner are disposed in alignment in the stated order. That is, the plurality of toner containers 3 are disposed in alignment along the left-right direction 8 in which the transfer belt 5A is extended. Among the plurality of toner containers 3, the toner container 3K is disposed at the right end. The toner container 3K stores black toner that is highly frequently used, and is larger in capacity and size than the other toner containers 3.

Figure 4:
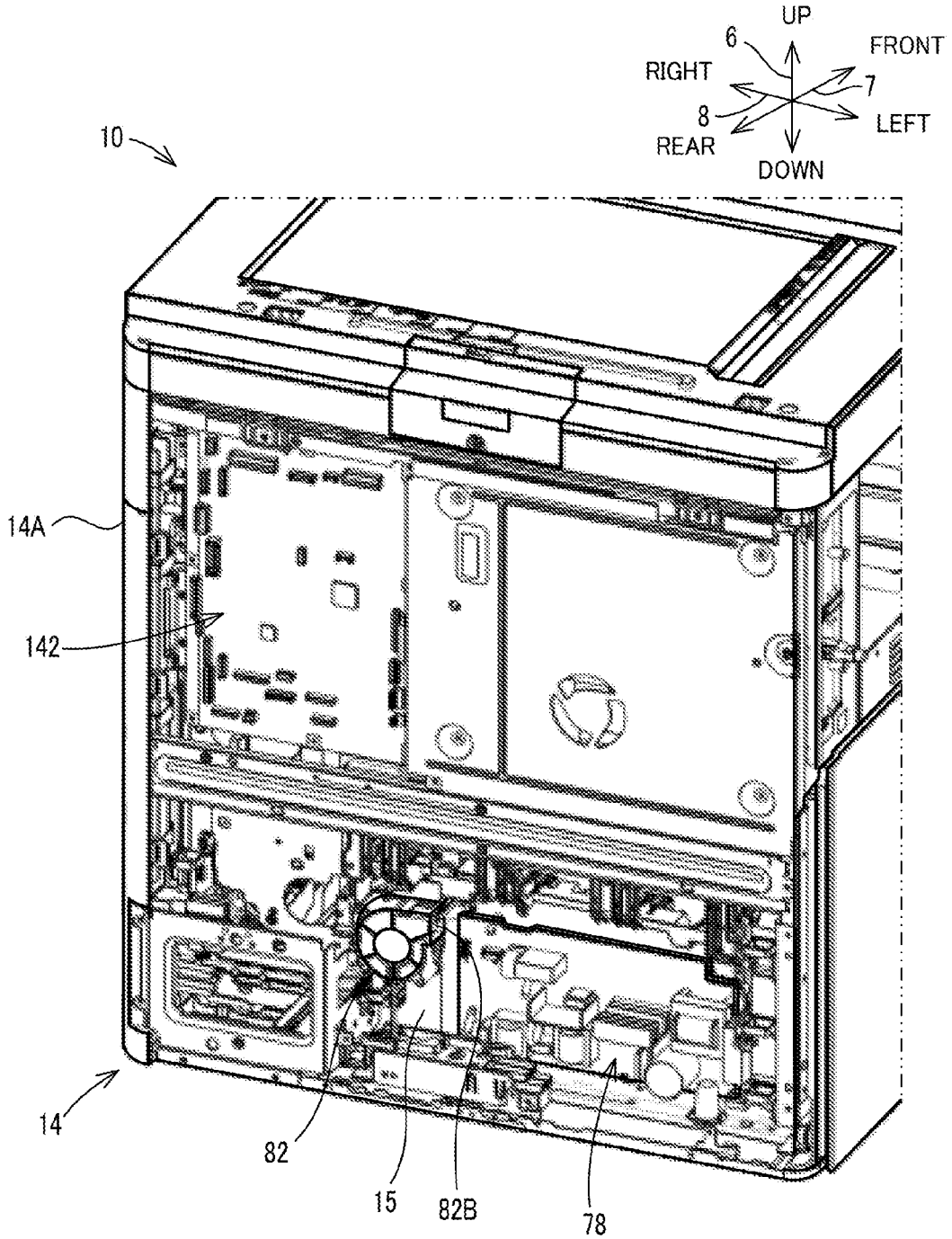
FIG. 4 is a perspective view showing the configuration of the rear side of the image forming portion.

FIG. 4 is a perspective view of the rear side of the image forming portion 14, wherein the rear panel of the image forming portion 14 is removed. FIG. 4 shows a state where the components provided in the second space 52 are exposed. As shown in FIG. 4, the power supply control board 78 is mounted to a side surface 15B (a side surface disposed on the second space 52 side) that is on the rear side of the partition plate 15. Specifically, the power supply control board 78 is disposed on the left end side of the lower portion of the side surface 15B. The power supply control board 78 is configured to convert a commercial power supply to a control power supply and a driving power supply that are used in the image forming apparatus 10, and supplies power to the components of the image forming apparatus 10. In the power supply control board 78, electronic devices such as an electrolytic capacitor, a coil, a converter such as an AC/DC converter, and a transformer for increasing or decreasing the voltage are implemented on a board. As a result, when the apparatus is powered on, the electronic devices in the power supply control board 78 emit heat and become heat sources. Thus, those electronic devices need to be cooled. It is noted that the power supply control board 78 is not limited to include components for controlling the power supply voltage, but may include a computing portion for controlling the operation of the image forming apparatus 10, and/or a driving circuit such as a motor driver.

Figure 5A:
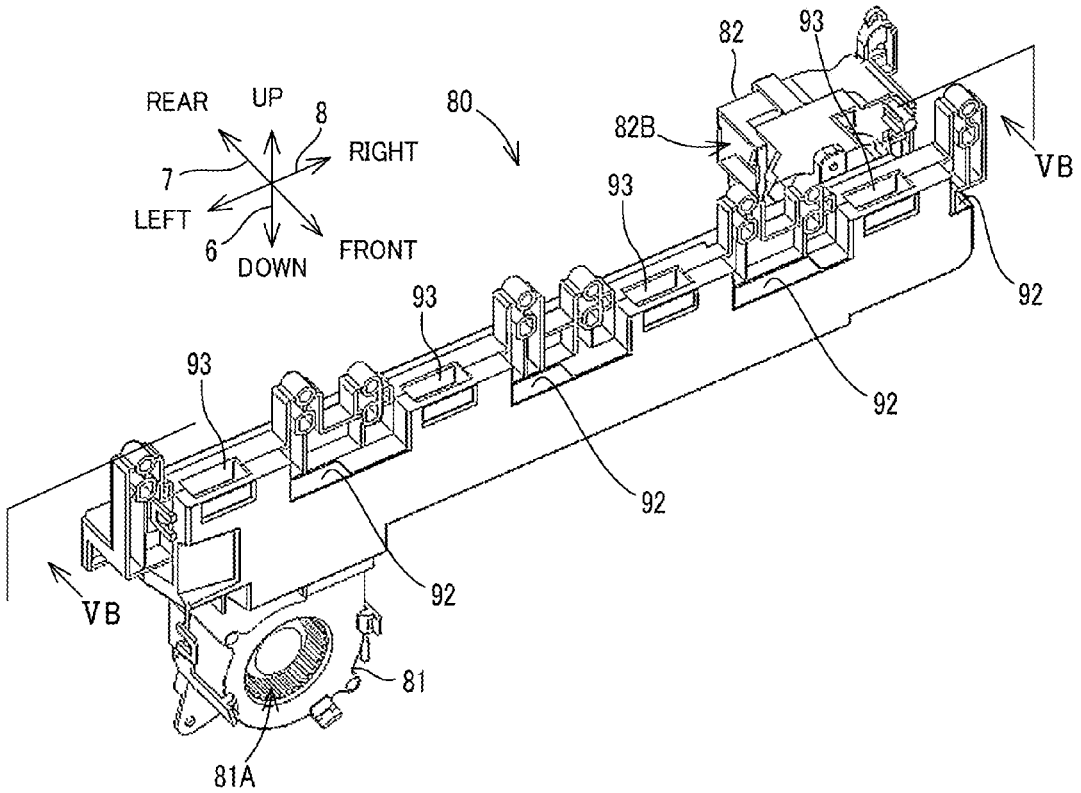
FIG. 5A and FIG. 5B are perspective views showing a cooling device included in the image forming portion.
Figure 5B:
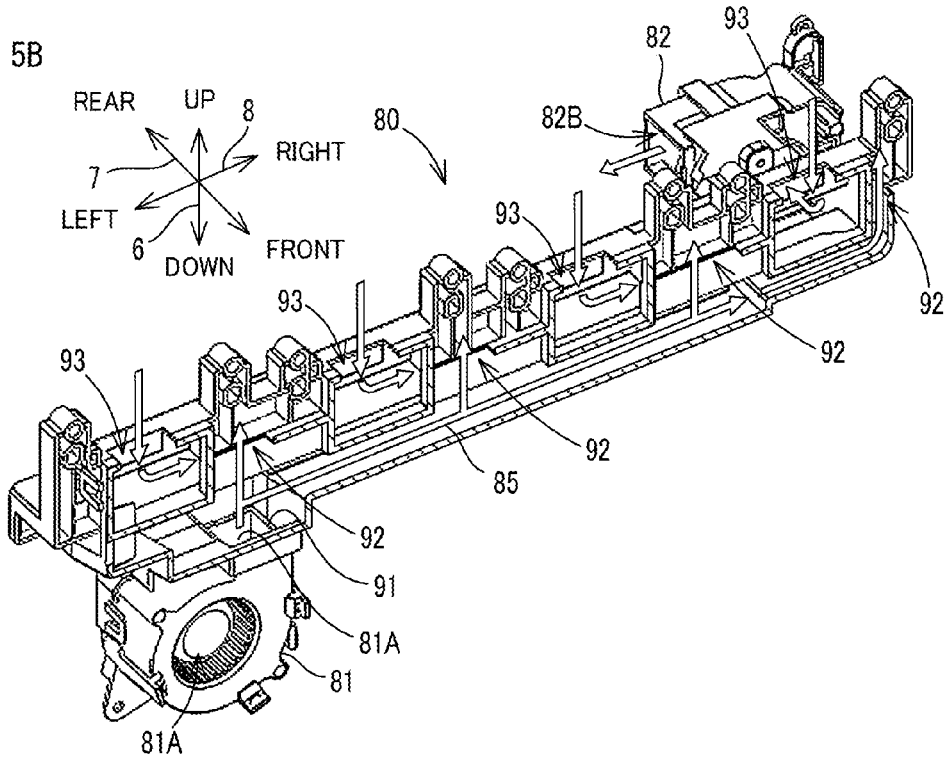

In FIG. 5A and FIG. 5B, the partition plate 15 is omitted, wherein the cooling device 80 is mounted to the partition plate 15. Arrows in FIG. 5A and FIG. 5B indicate the flows of air.

The cooling device 80 is configured to cool the inside of the image forming portion 14, and in particular, cool the power supply control board 78 and the developing device 44 that are internal devices of the image forming portion 14. In the present embodiment, the cooling device 80 cools the power supply control board 78 and the developing device 44 by taking in the air from the air inlet 29 and allowing the air to flow though the first air passage 71 and the second air passage 72 in separation, as described below. In addition, the cooling device 80 plays a role of discharging floating substances, such as floating toner, of the first space 51 to outside through the second space 52. As shown in FIG. 5A, FIG. 5B and FIG. 6, the cooling device 80 includes a first fan 81 (an example of the first blower of the present disclosure), a second fan 82 (an example of the second blower of the present disclosure), and a duct portion 83. As shown in FIG. 6, the first fan 81 and the duct portion 83 are provided in the first space 51, and the second fan 82 is provided in the second space 52. The first fan 81 and the second fan 82 are electrically driven blowers that suck in and blow out air.

Various types of fans such as a sirocco fan, a propeller fan, and an axial fan are applicable to the first fan 81 and the second fan 82.

The duct portion 83 is provided on a side surface 15A, a front side surface of the partition plate 15 (a side surface on the first space 51 side). The duct portion 83 is fixed to the side surface 15A by a fixing tool such as screws. As shown in FIG. 6, the duct portion 83 is disposed between the first air passage 71 and the second air passage 72 in the up-down direction 6. In other words, the duct portion 83 is disposed in rear of the image forming units 4. The duct portion 83 is formed in the shape of a rectangular parallelepiped that is elongated in the horizontal direction (the left-right direction 8) that is perpendicular to the direction in which the first air passage 71 extends (the front-rear direction 7), namely, the direction extending from the front surface 141 toward the rear surface 142. The duct portion 83 is fixed to the side surface 15A such that the longitudinal direction thereof matches the left-right direction 8 of the image forming apparatus 10.

A first internal passage 85 and a second internal passage 86 are formed in the duct portion 83. That is, the duct portion 83 includes the first internal passage 85 and the second internal passage 86. The first internal passage 85 is located on the front side of the duct portion 83, and the second internal passage 86 is located on the rear side of the duct portion 83. A partition wall 87 is provided in the duct portion 83, wherein the partition wall 87 is elongated in the longitudinal direction of the duct portion 83. The inner space of the duct portion 83 is partitioned into the first internal passage 85 and the second internal passage 86 by the partition wall 87 in the front-rear direction 7. In addition, the first internal passage 85 and the second internal passage 86 are independent air passages, not communicating with each other.

The first internal passage 85 receives the air from the first air passage 71 and allows the air to flow therein and guides the air to the second air passage 72. In the present embodiment, an inflow port 91 is formed in a lower surface of the left end portion of the duct portion 83. The air that has flowed through the first air passage 71 flows into the first internal passage 85 via the inflow port 91. In addition, outflow ports 92 are formed in a top surface of the duct portion 83. The air flows out from the first internal passage 85 via the outflow ports 92. As shown in FIG. 5A, a plurality of outflow ports 92 are formed in the top surface of the duct portion 83 along the longitudinal direction. In the present embodiment, four outflow ports 92 are formed in a front-side portion (that is on the front surface 141 side) of the top surface of the duct portion 83, directly above the first internal passage 85.

The second internal passage 86 receives the air from the second air passage 72 and allows the air to flow therein and guides the air to the second space 52 via a communication port 94 (see FIG. 6) that is formed in the partition plate 15. In the present embodiment, inflow ports 93 (an example of the inflow port of the present disclosure) are formed in the top surface of the duct portion 83, and the air that has flowed through the second air passage 72 flows into the second internal passage 86 via the inflow ports 93. A plurality of inflow ports 93 are formed in the top surface of the duct portion 83 along the longitudinal direction. In the present embodiment, four inflow ports 93 are formed in a rear-side portion (that is on the rear surface 142 side) of the top surface of the duct portion 83, directly above the second internal passage 86.

As shown in FIG. 5A, FIG. 5B and FIG. 6, the inflow ports 93 and the outflow ports 92 are disposed adjacent to each other. That is, the outflow ports 92 and the inflow ports 93 are disposed adjacent to each other in the top surface of the duct portion 83. Specifically, the inflow ports 93 except for a left-end inflow port 93 are each located in correspondence with a location between two outflow ports 92 that are adjacent in the left-right direction 8. Similarly, the outflow ports 92 except for a right-end outflow port 92 are each located in correspondence with a location between two inflow ports 93 that are adjacent in the left-right direction 8. In the present embodiment, each of the inflow ports 93 is formed at a position that corresponds to a middle position between two adjacent outflow ports 92. In other words, the outflow ports 92 and the inflow ports 93 are disposed alternately along the left-right direction 8, while shifting in position in the front-rear direction 7.

In a mount surface (a rear side surface) of the duct portion 83 that is mounted to the partition plate 15, a through hole passing through to the second internal passage 86 is formed. In addition, the partition plate 15 has the communication port 94 (see FIG. 6) at a position facing the through hole. As a result, the second space 52 is communicated with the first space 51 via the communication port 94, the through hole, the second internal passage 86, and the inflow ports 93.

It is noted that the duct portion 83 may be configured to hold a rear end portion of a support frame (not shown) that supports the image forming units 4 in the image forming portion 14.

The first fan 81 is provided in the first space 51, together with the duct portion 83. As shown in FIG. 6, the first fan 81 is disposed below the duct portion 83 and is disposed in rear of the sheet feed cassette 27 in the front-rear direction 7. The first fan 81 is mounted to the side surface 15A of the partition plate 15 via a bracket 89. Specifically, the bracket 89 is fixed to the side surface 15A, and the first fan 81 is fixed to the bracket 89. The first fan 81 is configured to suck air from the first air passage 71 and blow out the air to the first internal passage 85 of the duct portion 83. An inlet 81A of the first fan 81 is oriented toward the first air passage 71, and an outlet 81B of the first fan 81 is air-tightly connected to the inflow port 91. With this configuration, when the first fan 81 is driven, the air of the first air passage 71 is sucked into the inlet 81A of the first fan 81, and the air is blown out from the outlet 81B of the first fan 81. The blown-out air is sent to the first internal passage 85 of the duct portion 83. At this time, the internal pressure of the first air passage 71 becomes negative since the air thereof is sucked by the first fan 81, but external air flows into the first air passage 71 from the air inlet 29 of the front surface 141. That is, as the first fan 81 is driven, external air flows into the inside of the housing 14A via the air inlet 29, and the air passes through the first air passage 71 and reaches the first fan 81, and the air is sent to the first internal passage 85 of the duct portion 83 by the first fan 81. Subsequently, the air passes through the first internal passage 85 and is discharged to the second air passage 72 from the plurality of outflow ports 92.

The second fan 82 is provided in the second space 52. Specifically, the second fan 82 is mounted to the side surface 15B of the partition plate 15. The second fan 82 is configured to suck air from the second air passage 72 and blow out the air to the second space 52 through the second internal passage 86 of the duct portion 83 and the communication port 94. As shown in FIG. 6, the inlet 82A of the second fan 82 is air-tightly connected to the communication port 94 of the partition plate 15. In addition, the outlet 82B of the second fan 82 is oriented toward the power supply control board 78. In other words, the second fan 82 is mounted to the partition plate 15 such that the outlet 82B is oriented toward the power supply control board 78. It is noted that the power supply control board 78 is disposed more on the left side than the second fan 82 as is clearly shown in FIG. 4, but not in FIG. 6 in which the power supply control board 78 is represented by a dotted line. Upon being driven, the second fan 82 blows out the air toward the second space 52. This allows the air of the second air passage 72 to flow into the second internal passage 86 via the plurality of inflow ports 93, and then reach the through hole. The air having flowed in through the inflow ports 93 is collected by the second internal passage 86, and the collected air is sucked into the inlet 82A of the second fan 82 via the communication port 94. The air sucked into the inlet 82A is blown out to the second space 52 from the outlet 82B of the second fan 82. At this time, the internal pressure of the second air passage 72 becomes negative since the air thereof is sucked by the second fan 82, but external air flows into the second air passage 72 from the air inlet 29 of the front surface 141. That is, when the second fan 82 is driven, external air flows into the inside of the housing 14A via the air inlet 29, and the air passes through the second air passage 72 and reaches the duct portion 83, and is sent to the second internal passage 86. Subsequently, the air passes through the second internal passage 86 and is discharged to the second space 52 from the communication port 94. At this time, the air is blown out toward the power supply control board 78.

In the cooling device 80, the first fan 81 and the second fan 82 are driven always, or at necessary timing. In the present embodiment, the first fan 81 and the second fan 82 are driven at the same timing. The air sending forces of the first fan 81 and the second fan 82 are set such that the air flow rates per unit time in the first air passage 71 and the second air passage 72 are approximately the same. The cooling device 80 is used to cool the power supply control board 78 or the developing devices 44. As a result, the cooling device 80 is preferably driven for a period during which a temperature rise of the power supply control board 78 or the developing devices 44 may occur, namely for a period from a start to an end of image formation, or for a period from a start of image formation to a lapse of a predetermined time after an end of the image formation.

In the image forming apparatus 10 of the present embodiment having the above-described configuration, as shown in FIG. 6, when the first fan 81 and the second fan 82 are driven, air flows in from the air inlet 29 of the front surface 141. The air is then divided into two flows of air: one flowing into the first air passage 71; and the other flowing into the second air passage 72. While passing through the first air passage 71 toward the rear, the air cools the bottoms of the developing devices 44. This allows the developing devices 44 to be cooled, as well as the toner (developer) inside thereof. After passing through the first air passage 71, the air is sucked into the first internal passage 85 via the inflow port 91 of the duct portion 83 by the first fan 81. The air then passes through the first internal passage 85, and is discharged upward from the outflow ports 92. On the other hand, while passing through the second air passage 72 toward the rear, the air cools the transfer belt 5A and the bottom of the container unit 31. Thus the bottoms of the plurality of toner containers 3 attached to the container unit 31 are cooled by the air. In addition, while the air passes through the second air passage 72 toward the rear, the air causes the floating substances, such as floating toner, to move toward the rear. The air having passed through the second air passage 72 is sucked into the second internal passage 86 via the inflow ports 93 of the duct portion 83, by the second fan 82. At this time, the air that has passed through the first internal passage 85 and has been discharged upward from the outflow ports 92 is also sucked into the second internal passage 86 from the inflow ports 93. The air passes through the second internal passage 86 and the communication port 94, is then sucked into the inlet 82A of the second fan 82, and is blown out from the outlet 82B into the second space 52. Since the outlet 82B is oriented toward the power supply control board 78, the power supply control board 78 is cooled by the blown-out air. In addition, the air blown out into the second space 52 is exhausted to outside together with the floating substances, via gaps between the components in the housing 14A or an exhaust outlet (not shown) provided in the housing 14A.

According to the conventional cooling structure, air that has absorbed the heat of the power supply control board 78 is blown into the housing 14A. As a result, the devices stored in the housing 14A cannot be cooled efficiently. In particular, devices, such as the developing devices 44, that contain toner cannot be cooled. This results in a failure to prevent an image defect from occuring, which may be caused by the reduction of fluidity or charged amount of toner. In addition, when the air is blown into the housing 14A, the toner floating in the housing 14A is diffused to the whole inner space of the housing 14A. This allows the floating toner to adhere to a non-image region of the transfer belt 5A, and thus an image defect, so-called toner fogging, may occur.

However, according to the above-described image forming apparatus 10, airflows are generated inside the image forming apparatus 10, and the airflows are eventually discharged to outside. It is accordingly possible to inhibit a temperature rise in the developing device 44 and the power supply control board 78, and possible to discharge the floating substances, such as floating toner, to outside from the image forming portion 14.

It is noted that in the above-described embodiment, the image forming apparatus 10 is described as one embodiment of the present disclosure. However, the present disclosure may be recognized as the cooling device 80 that is used in the image forming apparatus 10.

In addition, in the above-described embodiment, the duct portion 83 including the plurality of outflow ports 92 and the plurality of inflow ports 93 is described as one example. However, the duct portion 83 may include one outflow port 92 and one inflow port 93. Furthermore, in the above-described embodiment, the air inlet 29 is provided in the recessed portion 27C of the front panel 27A of the sheet feed cassette 27, as one example. However, it suffices that the air inlet 29 is provided in the front surface 141 of the housing 14A.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a housing having a front surface and a rear surface that are disposed opposite to each other, an air inlet being formed in the front surface;

a partition wall member dividing an inner space of the housing into a first space and a second space, the first space being on a front surface side, the second space being on a rear surface side;

a developing portion disposed in the first space and configured to perform a developing process by using toner;

a transfer portion disposed above the developing portion and including a transfer belt that extends in a horizontal direction;

a first air passage formed below the developing portion and extending from the air inlet toward the rear surface;

a sheet storage portion provided below the developing portion such that the first air passage is formed between the sheet storage portion and the developing portion, the sheet storage portion being configured to store a plurality of sheet members;

a second air passage formed above the transfer portion and extending from the air inlet toward the rear surface;

a container attachment portion which is disposed above the transfer belt so that a gap constituting the second air passage is formed between the transfer portion and the container attachment portion, and to which a plurality of toner containers are attached;

a duct portion provided on a side surface of the partition wall member on a first space side and including a first internal passage and a second internal passage, the first internal passage allowing air that has flowed in from the first air passage to flow therein and guiding the air to the second air passage, the second internal passage allowing air that has flowed in from the second air passage to flow therein and guiding the air to the second space via a communication port that is formed in the partition wall member, the duct portion being formed in a shape of a rectangular parallelepiped that is elongated in a horizontal direction that is perpendicular to a direction in which the first air passage extends from the front surface toward the rear surface;

a first blower provided together with the duct portion in the first space and configured to suck air from the first air passage and blow out the air to the first internal passage of the duct portion;

a control board provided on a side surface of the partition wall member on a second space side and used to control the image forming apparatus; and a second blower provided in the second space and mounted to the side surface of the partition wall member on the second space side, and configured to suck air from the second air passage and blow out the air to the second space through the second internal passage of the duct portion and the communication port, and send the air toward the control board provided in the second space so as to cool the control board, wherein the sheet storage portion is configured to be inserted into the housing from the front surface side in a front-rear direction of the housing and extracted to the front surface side, and includes a front panel that constitutes a part of the front surface of the housing, the front panel has a recessed portion and a handle, the recessed portion recessing toward the rear side and being formed at a center of the front panel in its width direction, the handle being made to run across the recessed portion in the width direction, the air inlet is formed in a top wall surface of the recessed portion so as to communicate with the inner space of the housing, the duct portion includes a plurality of outflow ports and a plurality of inflow ports, the plurality of outflow ports being formed for the air in the first internal passage to flow out to the first space, the plurality of inflow ports being formed for the air from the second air passage to flow into the second internal passage, the plurality of outflow ports and the plurality of inflow ports are formed in a top surface of the duct portion along a longitudinal direction of the duct portion and are disposed alternately along the longitudinal direction, while shifting in position in the direction in which the first air passage extends, the plurality of outflow ports are formed in a portion of the top surface of the duct portion that is on the front surface side and directly above the first internal passage, and the plurality of inflow ports are formed in a portion of the top surface of the duct portion that is on the rear surface side and directly above the second internal passage, the first blower is located in the first space below the duct portion close to one of opposite ends in the horizontal direction and more on the rear surface side than the sheet storage portion, sucks the air from the first air passage and blows out the air to the first internal passage of the duct portion, thereby discharging the air from the plurality of outflow ports to the second air passage, and the second blower is located to be higher than the first blower and close to the other of the opposite ends in the horizontal direction, blows out the air to the second space, thereby allowing the air to flow into the second internal passage from the second air passage via the plurality of inflow ports, collects the air that has flowed into the second internal passage and sends the collected air to the second space via the communication port.

* * * * *